United States Patent [19]

Morikawa

[11] Patent Number: 4,967,711

[45] Date of Patent: Nov. 6, 1990

[54] FUEL INJECTION CONTROL SYSTEM FOR AUTOMOTIVE ENGINE

[75] Inventor: Koji Morikawa, Musashino, Japan

[73] Assignee: Fuji Jukogyo Kabushiki Kaisha, Tokyo, Japan

[21] Appl. No.: 383,873

[22] Filed: Jul. 21, 1989

[30] Foreign Application Priority Data

Jul. 29, 1988 [JP] Japan ..... 63-191120

[51] Int. Cl.[5] ..... F02D 41/00

[52] U.S. Cl. ..... 123/478; 123/492

[58] Field of Search ..... 123/478, 492, 480, 494; 364/431.07

[56] References Cited

U.S. PATENT DOCUMENTS 4,705,001 11/1987 Danno et al. ..... 123/478
4,706,632 11/1987 Kasanami et al. ..... 123/492
4,714,067 12/1987 Staerzl ..... 123/494
4,725,954 2/1988 Takao et al. ..... 123/492
4,733,358 3/1988 Abthoff et al. ..... 364/431.05
4,736,725 4/1988 Iwaki et al. ..... 123/492
4,763,264 8/1988 Okuno et al. ..... 123/478

FOREIGN PATENT DOCUMENTS 60-47836 3/1985 Japan ..... 123/480

*Primary Examiner*—Raymond A. Nelli
*Attorney, Agent, or Firm*—Martin A. Farber

[57] ABSTRACT

A pressure sensor is provided for detecting the pressure of intake air in a cylinder of an engine. A pressure difference between a first cylinder pressure detected after closing an intake valve and a second cylinder pressure after the first cylinder pressure detection and before an ignition timing. The quantity of intake air is calculated based on the pressure difference and the engine seed. A basic fuel injection pulse width in calculated based on the calculated quantity of intake air. A fuel injector is actuated in accordance with the calculated basic fuel injection pulse width for injecting fuel.

2 Claims, 7 Drawing Sheets

FUEL INJECTION CONTROL SYSTEM FOR AUTOMOTIVE ENGINE

BACKGROUND OF THE INVENTION

The present invention relates to a system for controlling fuel injection in an automotive engine in dependency on pressure in cylinders of the engine. The pressure in the cylinders is used as a parameter representing the quantity of intake air, for deciding an air-fuel ratio of mixture.

In a known fuel injection system, a fuel injection quantity is calculated based on the intake air quantity which is detected by an airflow meter. However, the airflow meter is not accurate enough for obtaining an optimum air-fuel ratio. Thus, there has been proposed a system for accurately controlling the fuel injection where the quantity of fuel to be injected is calculated in dependency on the pressure of intake air in the cylinder. The system excels the system with the airflow meter in accuracy. However, when a piezoelectric sensor is used for detecting absolute pressure, accurate measurement is not obtained because of the drift of the sensor.

Japanese Patent Application Laid Open No. 60-47836 discloses a system for controlling air-fuel ratio, wherein the quantity of intake air is obtained from the difference P between a minimum pressure Pmin detected at the bottom dead center (BDC) and a pressure detected at the crank angle of 140 degrees. By using the relative pressure, the problem of the drift in the pressure is solved.

However, the intake valve of the cylinder having the pressure sensor is still open at the BDC so that the minimum pressure Pmin in the cylinder oscillates because of pulsation of intake air. Consequently, the pressure is not accurately detected.

In addition, in the control system, when an accelerator pedal of a vehicle is depressed for accelerating the vehicle, a lean spike or a rich spike of the air-fuel ratio is formed as a result of inappropriate control of fuel quantity.

SUMMARY OF THE INVENTION

An object of the present invention is to provide a system for properly controlling fuel injection, where pressures in cylinders of an engine are accurately detected without influence of pulsation of intake air, thereby improving fuel consumption and engine operation.

Another object of the present invention is to control properly the air-fuel ratio of fuel mixture at transient state.

According to the present invention, there is provided a system for controlling fuel injection in an automotive engine having at least one cylinder and a fuel injector, comprising a pressure sensor provided for detecting the pressure of intake air in the cylinder, an engine speed calculator for producing an engine speed signal dependent on engine speed, pressure difference calculator means for calculating a pressure difference between a first cylinder pressure detected after closing an intake valve and a second cylinder pressure after the first cylinder pressure detection and before an ignition timing, intake air calculator means for calculating quantity of intake air based on the pressure difference and the engine speed signal, pulse width calculator means for calculating a basic fuel injection pulse width based on the calculated quantity of intake air, and actuating means for actuating the fuel injector in accordance with the calculated basic fuel injection pulse width for injecting fuel.

In an aspect of the invention, there is further provided a system for controlling fuel injection in an automotive engine having at least one cylinder and a fuel injector, comprising a pressure sensor provided for detecting the pressure of intake air in said cylinder, an engine speed calculator for producing an engine speed signal dependent on engine speed, pressure difference calculator means for calculating a pressure difference between a first cylinder pressure detected after closing an intake valve and a second cylinder pressure after the first cylinder pressure detection and before an ignition timing, intake air calculator means for calculating quantity of intake air based on the pressure difference and the engine speed signal, pulse width calculator means for calculating a basic fuel injection pulse width based on the calculated quantity of intake air, actuating means for actuating the fuel injector in accordance with the calculated basic fuel injection pulse width for injecting a fuel, acceleration detector means for detecting acceleration of the engine, memory means storing a plurality of coefficients for correcting the basic fuel injection pulse width in accordance with magnitude of the detected acceleration and for providing an additional fuel injection pulse width, air-fuel ratio calculator means for calculating an air-fuel ratio from the sum of the basic fuel injection pulse width and the additional fuel injection pulse width, comparator means for comparing the calculated air-fuel ratio with a predetermined reference range and for producing a deviation signal when the calculated air-fuel ratio is outside the reference range, correcting means responsive to the deviation signal for correcting a corresponding coefficient so as to converge the deviated air-fuel ratio in the reference range.

The other objects and features of this invention will be apparently understood from the following description with reference to the accompanying drawings.

DETAILED DESCRIPTION OF THE PREFERRED EMBODIMENTS

Figure 1:
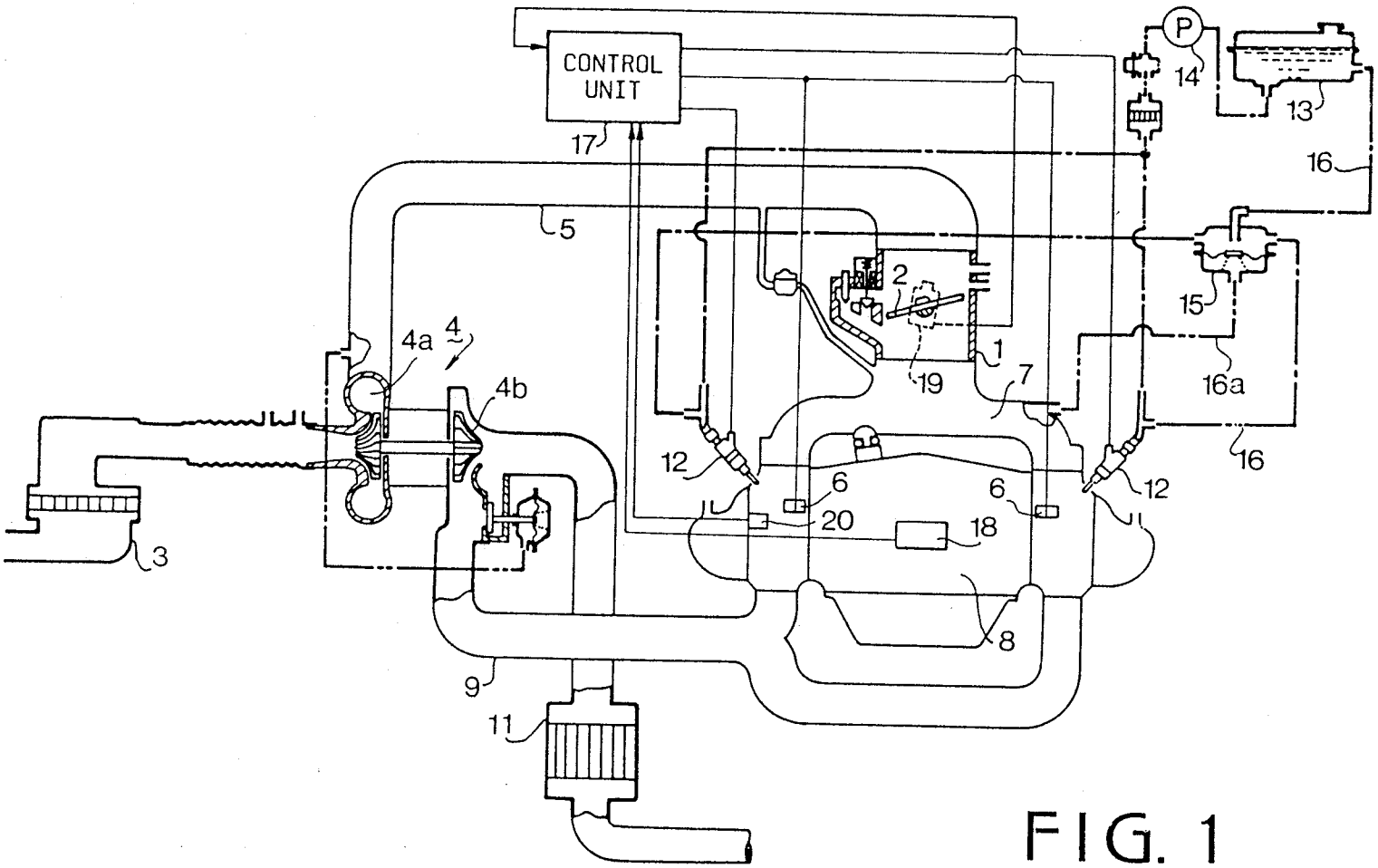
FIG. 1 is a schematic diagram showing a system of the present invention.

Referring to FIG. 1, an engine 8 has a throttle body 1 having a throttle valve 2 communicated with an intake pipe 5. In the intake system, an air cleaner 3, and a compressor **4*a* of a turbocharger 4 are provided. The throttle body 1 is further communicated with an intake manifold 7 which is communicated with a combustion chamber of each cylinder (not shown) in an engine 8. In an exhaust pipe 9, an exhaust gas turbine 4*b* and a catalytic converter 11 are provided. Fuel is supplied to fuel injectors 12 from a fuel tank 13 by a fuel pump 14, and returned to the tank 13 through a passage and a pressure regulator 15 which is regulated by intake manifold pressure applied through a pipe 16a. A piezoelectric pressure sensor 6 is provided in each cylinder and a throttle position sensor 19 is attached to the throttle body 1 for detecting the throttle valve opening degree, i.e. engine operating conditions. A coolant temperature sensor 20 is provided in the engine 8 for detecting of temperature of coolant. A crank angle sensor 18 is further provided in the engine 8 for detecting engine speed. Output signals of the sensors 6, 18, 19 and 20 are applied to a control unit 17 for controlling fuel injectors 2**.

Figure 2A:
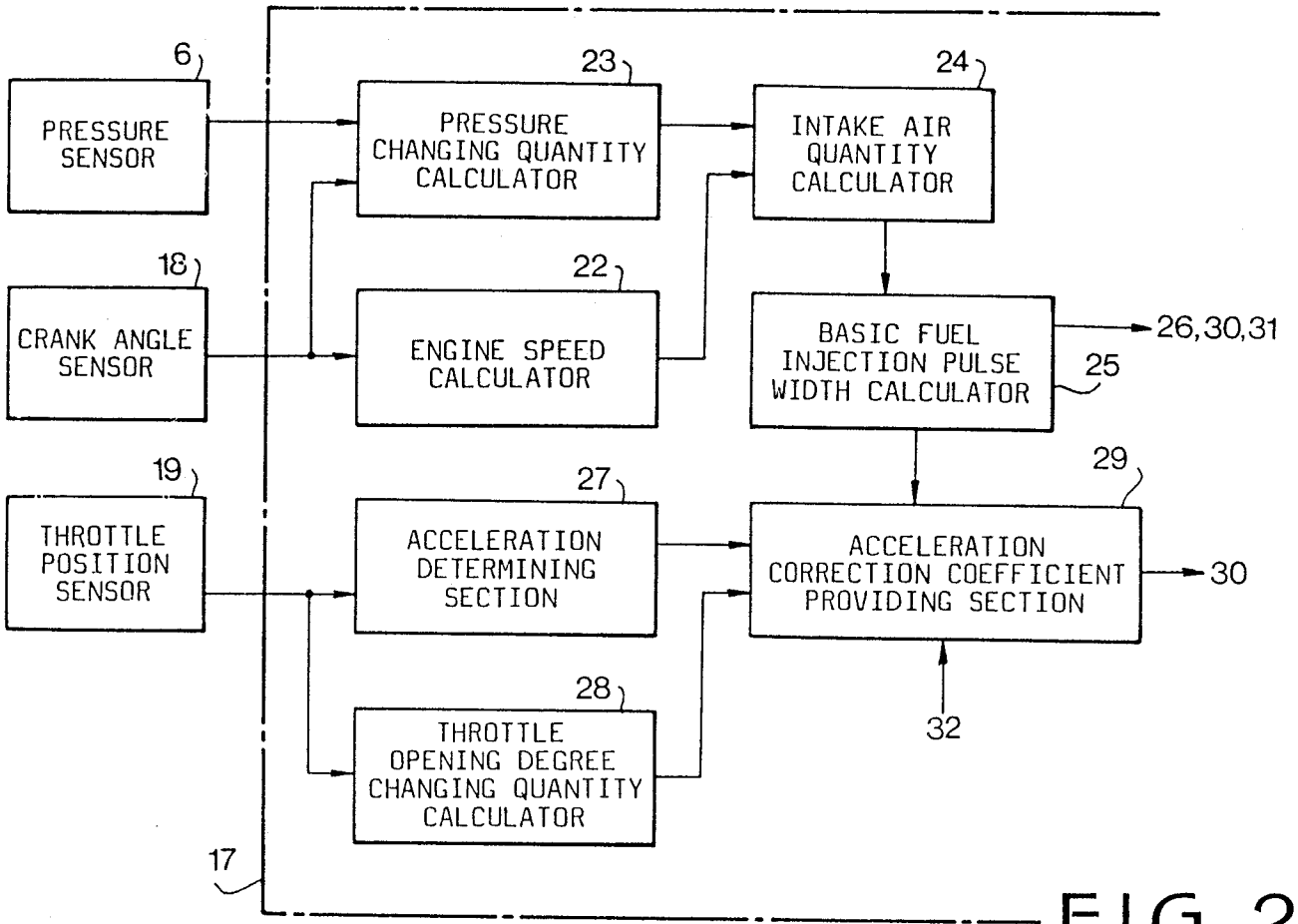
FIG. 2 is a block diagram of a control system of the present invention.
Figure 2B:
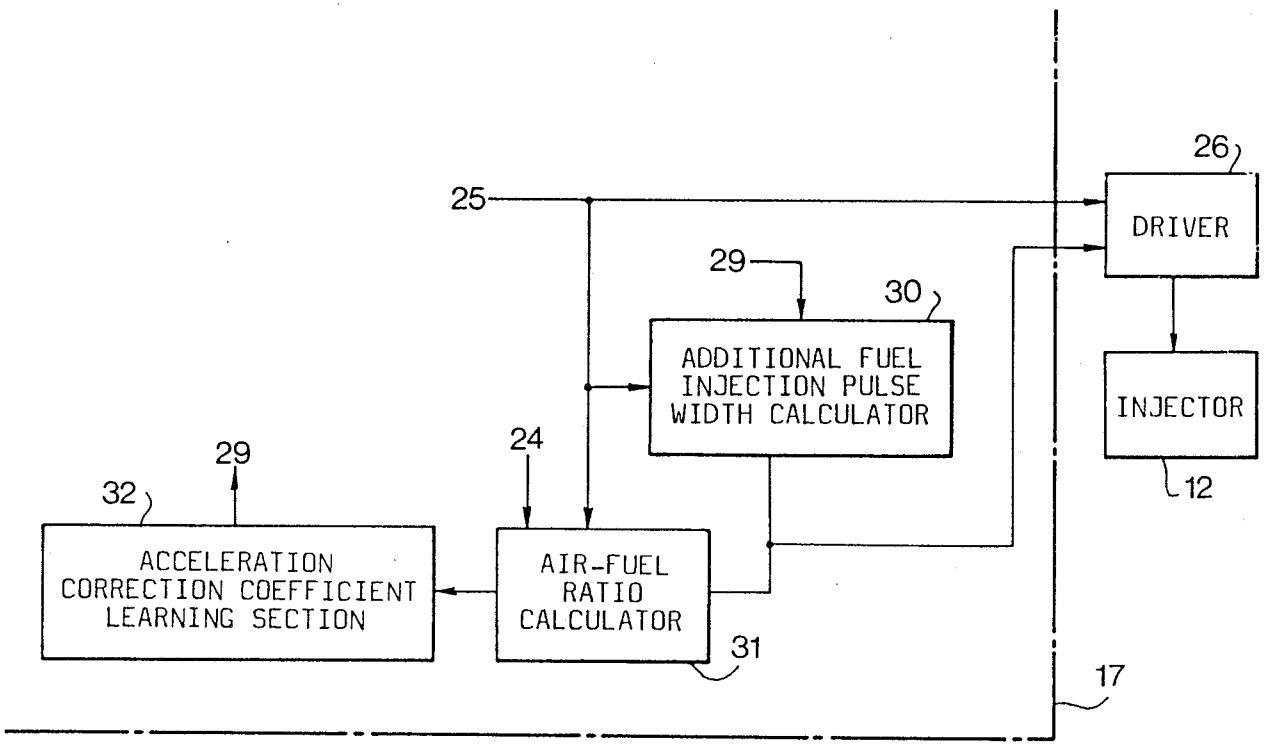
Figure 4:
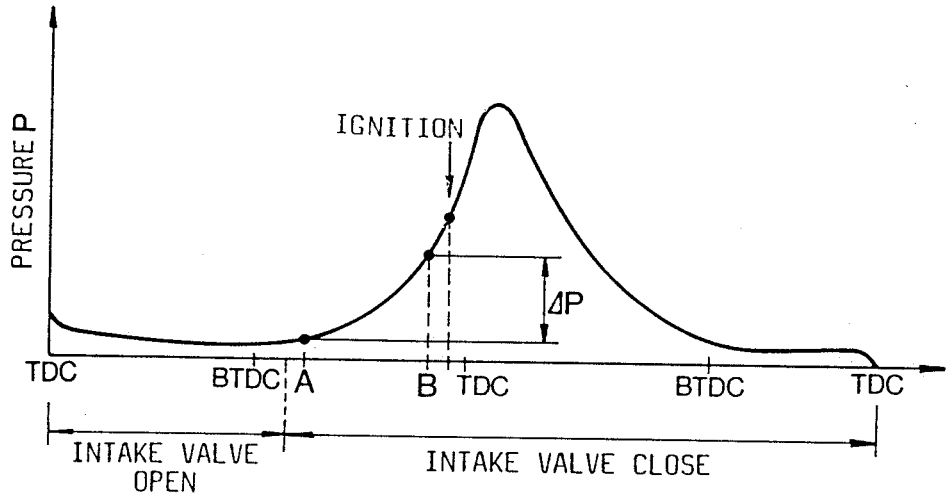
FIG. 4 is a graph showing timings for detecting a pressure in a cylinder of an engine.

Referring to FIG. 2, the control unit 17 comprises an engine speed calculator 22 which calculates an engine speed N dependent on an output signal from the crank angle sensor 18. The output signal of the crank angle sensor 18 is further applied to a pressure changing quantity calculator 23 where increase of the pressure in the cylinder during the compression stroke is calculated. Namely, as shown in FIG. 4, a first pressure PA is detected at a crank angle A immediately after an intake valve is closed. A second pressure PB is detected at a crank angle B immediately before the ignition, that is, before a maximum advance angle of the ignition timing. Thus, a pressure changing quantity $\Delta P$ (relative value) is calculated in accordance with $\Delta P = PB - PA$.

Figure 5:
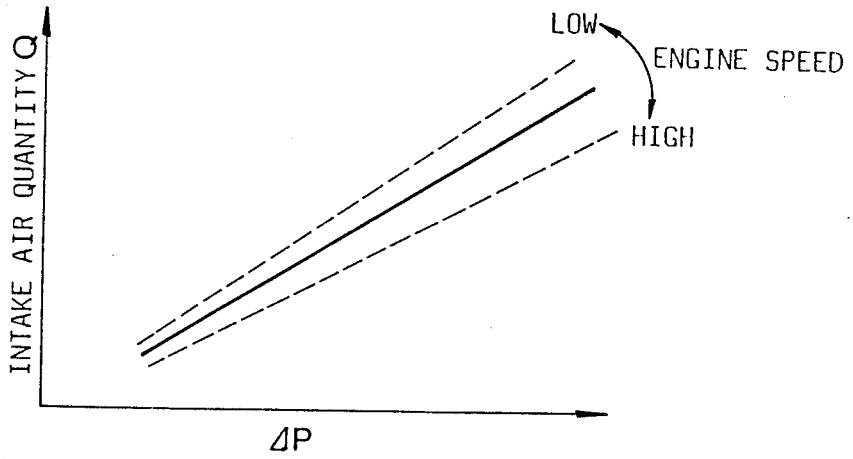
FIG. 5 is a graph showing the relationship between an increment of pressure and intake air quantity with respect to engine speed.

The changing quantity $\Delta P$ and the engine speed N from the calculator 22 are fed to an intake air quantity calculator 24 where an intake air quantity Q is calculated based on data derived from a table in accordance with the engine speed N and the quantity $\Delta P$. As shown in FIG. 5, the intake air quantity Q is a linear function of the changing quantity $\Delta P$. The intake air quantity Q is stored in a memory such as a RAM. The intake air quantity Q is applied to a basic fuel injection pulse width calculator 25 where a basic fuel injection pulse width Tp is calculated as follows:

$$Tp = Q/(A/F)$$

where A/F is a predetermined desired air-fuel ratio (stoichiometry). The pulse width Tp is applied to the injectors 12 through a driver 26 for injecting fuel.

The control unit 17 further comprises a system for controlling the air-fuel ratio at a transient state with an additional fuel injection. An acceleration determining section 27, is applied with an output signal of the throttle position sensor 19. A throttle opening degree Th is obtained with the time division of the output signal. The acceleration determining section 27 detects an increase of the throttle opening degree Th within a predetermined period and determines that the vehicle is accelerated.

In a throttle opening degree changing quantity calculator 28, the throttle opening degree Th is differentiated to obtain a changing quantity $\Delta Th$. Output signals of the deciding section 27 and the calculator 28 are fed to an acceleration correction coefficient providing section 29 where an acceleration correction coefficient K in dependency on the changing quantity $\Delta Th$ is derived from a coefficient table when the vehicle is accelerated. In accordance with the coefficient providing section 29, the coefficient K is stored in a RAM. An additional fuel injection pulse width calculator 30 calculates an additional fuel injection pulse width Tc in accordance with $$Tc - Tp \times K$$

The additional fuel injection pulse width Tc is fed to the driver 26 to inject fuel after the basic fuel injection.

The basic fuel injection pulse width Tp and the additional fuel injection pulse width Tc are stored in a memory provided in an air-fuel ratio calculator 31. When the intake air quantity Q is fed to the air-fuel ratio calculator 31 at the next program (the next cycle of the cylinder), an air-fuel ratio A/F is calculated based on the stored injection pulse widths Tp and Tc ($A/F = Q/(Tp + Tc)$). When the air-fuel ratio A/F exceeds a permissible air-fuel ratio range, the air-fuel ratio calculator 31 applies a signal to a correction coefficient learning section 32 where the acceleration coefficient K is corrected by learning. When the air-fuel mixture is too lean, a coefficient KOLD derived at the last program is increased by a predetermined rate $\Delta K$, for example 0.02. Thus, a new correction coefficient K is obtained by $$K = K_{OLD} \times (1 + 0.02)$$

To the contrary, when the air-fuel mixture is extremely rich, the coefficient K is decreased as follows.

$$K = K_{OLD} \times (1 - 0.02)$$

The corrected coefficient K is stored at the corresponding address in the coefficient table of the coefficient providing section 29.

If the calculated timing of the additional fuel injection coincides with that of the basic fuel injection, the timing for the additional fuel injection is adjusted so as to start the additional fuel injection immediately after the basic injection.

Figure 3A:
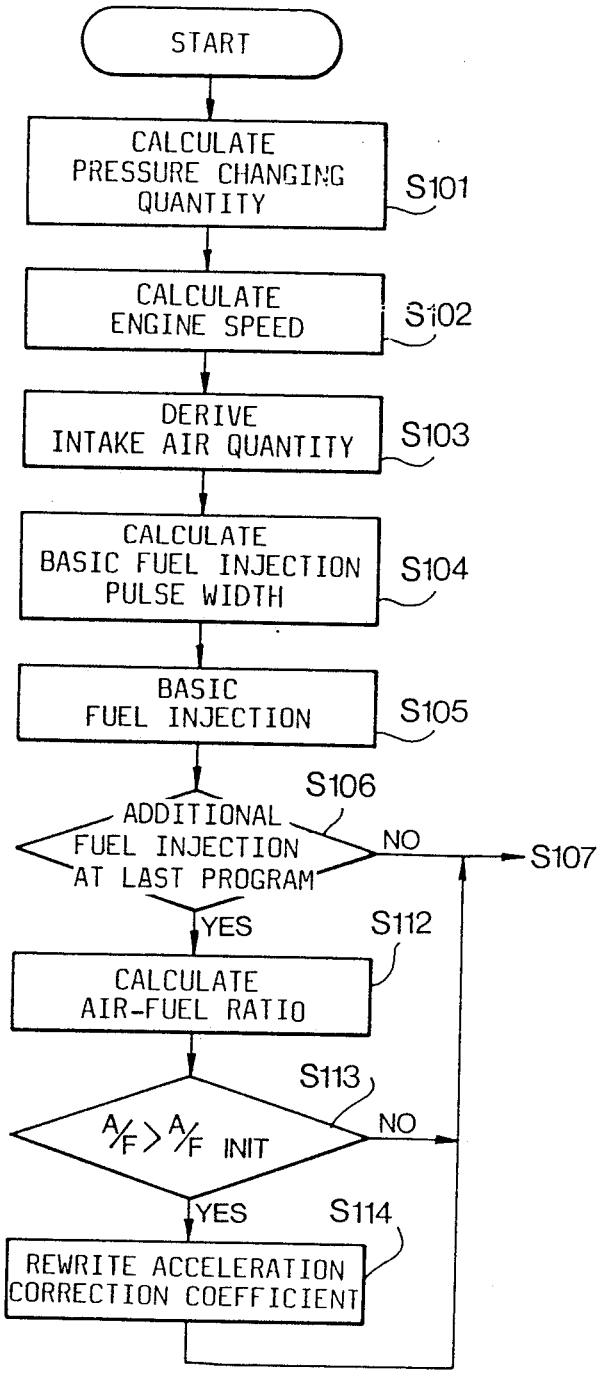
FIG. 3 is a flow chart showing operations of the control system.
Figure 3B:
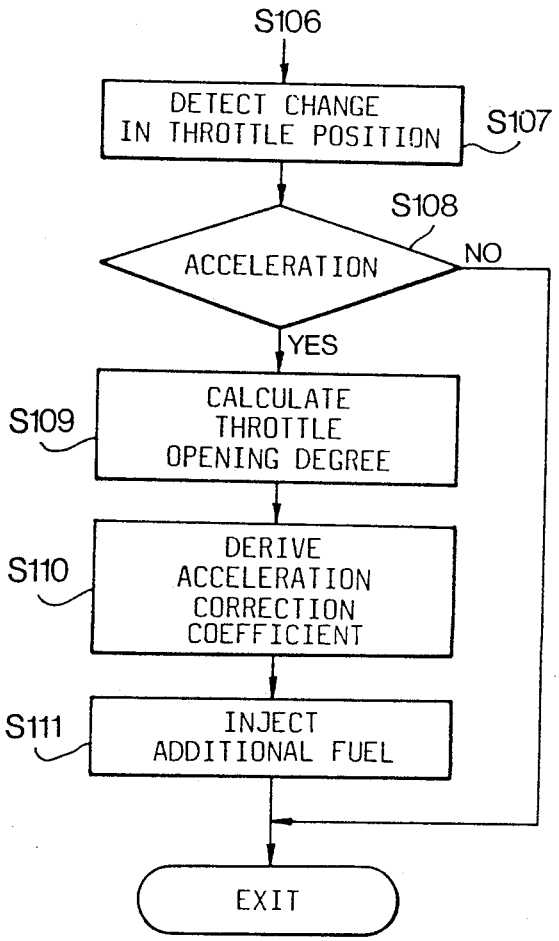

The operation of the system will be described with reference to a flow chart shown in FIG. 3 and to a time chart shown in FIG. 6.

A program which starts at a point b shown in the time chart is explained. At a step S101, a pressure changing quantity $\Delta P$ during a predetermined period between the intake valve closing time and the ignition time, namely during the compression stroke, is calculated. At a step S102, the engine speed N is calculated by the calculator 22. At a step S103, an intake air quantity Q is obtained from the table in the providing section 24 in accordance with the changing quantity $\Delta P$ and the engine speed N, with using the interpolation if necessary. The intake air quantity Q is stored in a memory. A basic fuel injection pulse width Tp is calculated at a step S104. At a step S105, the driver 26 is actuated so as to inject fuel through the injector 12 in accordance with the basic fuel injection pulse width Tp.

At a step S106, it is determined whether an additional fuel injection has taken place during the last program between the points a and b in the time chart. When the acceleration deciding section 27 determined that the vehicle is accelerated at the last program, a flag has been set. Accordingly, when it is determined that the flag is set at the step S106, it means that the vehicle is accelerated so that the additional fuel injection was performed at the last program. Since the flag is not set at the present program, the program goes to a step S107.

At the step S107, the change of the throttle valve opening degree is detected and at a step S108 the detection of acceleration is taken place in the acceleration deciding section 27 dependent on the change of the throttle valve opening degree. When an acceleration is determined at a point c in FIG. 6, the program proceeds to a step S109 where the throttle opening degree changing quantity ΔTh or changing rate is calculated. At a step S110, a correction coefficient K is derived from the table and stored in the memory. At a step S111, an additional fuel injection pulse width Tc is calculated in accordance with $Tc=Tp\times K$, and the injector 12 is actuated through the driver 26 for the additional injection at the point c. Accordingly, a total fuel injection pulse width T corresponding to the intake air quantity Q at the next cycle starting from a point d is a sum of the basic fuel injection pulse width Tp calculated at the point b and the additional injection pulse width Tc calculated at the point c. Consequently, an increase of intake air as a result of the increase of the throttle valve opening degree is compensated by the additional fuel injection.

Figure 6:
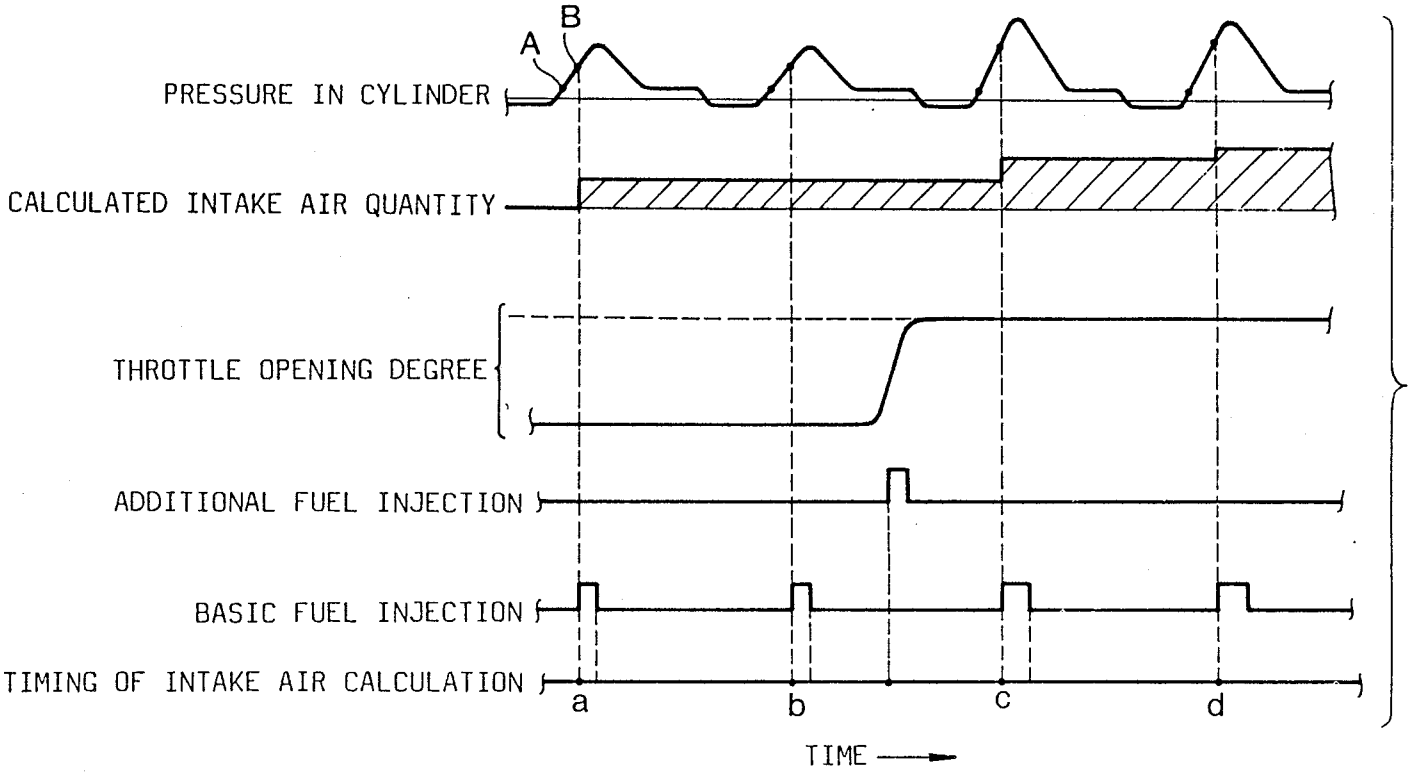
FIG. 6 is a time chart describing an operation of the control system.

In the next program, starting from the point d in FIG. 6, at the step S106, since there was an additional fuel injection between the points b and d, it is determined that the flag is set. The program goes to a step S112 after the flag is reset. At the step S112, the air-fuel ratio calculator 31 calculates an air-fuel ratio A/F based on the intake air quantity Q calculated and stored in the memory at the step S103 of the present program, and the basic fuel injection pulse width $Tp_{OLD}$ and the additional fuel injection pulse width $Tc_{OLD}$ stored at the last program. At a step S113, it is determined whether the calculated ratio A/F is within the permissible air-fuel ratio range $A/F_{INIT}$. If the ratio is within the range, the program proceeds to the step S107.

When the air-fuel ratio exceeds the permissible range, the program goes to a step S114 where the acceleration correction coefficient $K_{OLD}$ stored at the last program is corrected. When the air-fuel mixture is too rich, a new coefficient K is calculated in accordance with $K=K_{OLD}\times(1-\Delta K)$. For the lean air-fuel mixture, a new coefficient K is calculated in dependency on $K=K_{OLD}\times(1+\Delta K)$. The corrected coefficient K is written in the memory. The program further proceeds to the step S107 to carry out the additional fuel injection, the pulse width of which depends on the corrected coefficient K. Thus, the additional fuel injection pulse width is corrected by learning, thereby preventing the air-fuel mixture from becoming excessively rich or lean.

A throttle opening degree changing rate ΔTH may be obtained as a parameter for deriving the correction coefficient K instead of the throttle opening degree changing quantity ΔTH.

Although, the calculation of the fuel injection pulse width is performed at every cylinder, the fuel injection pulse width may be determined by the intake pressure difference detected in a selected cylinder for other cylinders than the selected cylinder.

From the foregoing, it will be understood that the present invention provides a system for controlling the fuel injection where the pressure in the cylinder is accurately determined even with a piezoelectric pressure sensor without being affected by pulsation of intake air. Furthermore, the quantity of injected fuel is increased by an additional fuel injection at a transient state so as to improve the driveability of the vehicle.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A system for controlling fuel injection in an automotive engine having at least one cylinder, a fuel injector, a throttle position sensor for detecting an opening degree of a throttle valve, a pressure sensor provided for detecting the pressure of intake air in said cylinder and a crank angle sensor for detecting an engine speed, comprising:

an engine speed calculator for producing an engine speed signal dependent on said engine speed;

pressure difference calculator means responsive to said pressure sensor and said crank angle sensor for calculating a pressure difference between a first cylinder pressure detected after closing an intake valve and a second cylinder pressure after the first cylinder pressure detection and before an ignition timing;

intake air calculator means responsive to said pressure difference calculator means and said engine speed calculator for calculating quantity of intake air based on the pressure difference and the engine speed signal;

pulse width calculator means responsive to said intake air calculator means for calculating a basic fuel injection pulse width based on the calculated quantity of intake air; and actuating means for actuating the fuel injector in accordance with the calculated basic fuel injection pulse width for injecting fuel.

2. The system according to claim 1, further comprising;

acceleration detector means for detecting acceleration of the engine;

memory means storing a plurality of coefficients for correcting the basic fuel injection pulse width in accordance with magnitude of the detected acceleration and for providing an additional fuel injection pulse width;

air-fuel ratio calculator means for calculating an air-fuel ratio from a sum of the basic fuel injection pulse width and the additional fuel injection pulse width;

comparator means for comparing the calculated air-fuel ratio with a predetermined reference range and for producing a deviation signal when the calculator air-fuel ratio is outside the reference range;

correcting means responsive to the deviation signal for correcting a corresponding coefficient so as to converge the deviated air-fuel ratio in the reference range.

* * * * *